US006393357B1

(12) United States Patent
Holmes et al.

(10) Patent No.: US 6,393,357 B1
(45) Date of Patent: May 21, 2002

(54) SYSTEM AND METHOD FOR INFERRING ENGINE OIL TEMPERATURE AT STARTUP

(75) Inventors: John William Holmes, Eastpointe; Michael John Cullen, Northville, both of MI (US); Nick Alfred Wicks, Rugby (GB)

(73) Assignees: Ford Global Technologies, Inc., Dearborn, MI (US); Jaguars Cars Limited, Coventry (GB)

( * ) Notice: Subject to any disclaimer, the term of this patent is extended or adjusted under 35 U.S.C. 154(b) by 12 days.

(21) Appl. No.: 09/617,383

(22) Filed: Jul. 17, 2000

(51) Int. Cl.[7] ..... F02N 15/10; F01M 11/10
(52) U.S. Cl. ..... 701/115; 701/102; 123/179.4
(58) Field of Search ..... 123/179.4, 196 R, 123/196.5; 701/35, 101, 102, 115; 702/130, 178

(56) References Cited

U.S. PATENT DOCUMENTS 5,072,703 A * 12/1991 Sutton ..... 123/179.4
5,173,856 A * 12/1992 Purnell et al. ..... 701/35
5,303,168 A 4/1994 Cullen
5,512,789 A 4/1996 Lyon
5,605,040 A 2/1997 Cullen
5,633,796 A 5/1997 Cullen
5,722,236 A 3/1998 Cullen
5,742,920 A * 4/1998 Cannuscio et al. ..... 701/102
6,026,679 A 2/2000 Holmes
6,170,452 B1 * 1/2001 Wisinski ..... 123/179.4

FOREIGN PATENT DOCUMENTS

JP 7-34927 A * 2/1995 ..... 123/179.4

* cited by examiner

*Primary Examiner*—Willis R. Wolfe
(74) *Attorney, Agent, or Firm*—Allan J. Lippa

(57) ABSTRACT

Systems and methods for determining engine oil temperature without an oil temperature sensor infer the oil temperature at engine start based on the calculated temperature at power down and various other parameters which may include engine coolant temperature, soak time, ambient temperature, and whether an engine block heater has been used. The invention provides a more accurate determination of engine oil temperature to allow more precise engine control particularly during cranking and during the first few minutes of engine operation.

22 Claims, 3 Drawing Sheets

SYSTEM AND METHOD FOR INFERRING ENGINE OIL TEMPERATURE AT STARTUP

TECHNICAL FIELD

The present invention relates to systems and methods for determining engine oil temperature at engine startup.

BACKGROUND ART

Engine oil temperature is one of many engine operating parameters which may be used to control an internal combustion engine. For example, engines having variable cam timing (VCT) which uses oil pressure to alter the timing of the intake and/or exhaust valves may use engine oil temperature to determine when VCT operation is allowable or desirable.

Prior art strategies for determining engine oil temperature used an oil temperature sensor to directly measure the temperature, or inferred oil temperature from various other engine sensors and operating conditions. Calculating oil temperature provides various benefits associated with elimination of a physical sensor on the engine. However, accurate inferred oil temperature during running of the engine, as described in U.S. Pat. No. 5,633,796 for example, relies on an accurate oil temperature at engine startup. Known strategies for inferring engine oil temperature at startup accounted for only the most common startup conditions and were therefore occasionally inaccurate. For example, the inventors herein have recognized that these strategies did not account for engine block heaters, engine restarts after a short drive followed by a short shut-down (or soak), or oil temperature changes if the engine was not cranked for some time period after turning the key to the "ON" position. The latter situation may occur when operating vehicle accessories for a period of time prior to starting the vehicle, such as when listening to the radio, for example.

SUMMARY OF THE INVENTION

An object of the present invention is to provide a system and method for more accurately determining engine oil temperature at engine startup without using an oil temperature sensor.

In carrying out the above object and other objects, advantages, and features of the present invention, a system and method for determining engine oil temperature at engine startup for an internal combustion engine include retrieving a shutdown engine oil temperature value previously stored in memory prior to the engine being shutdown, determining a value indicative of engine coolant temperature, determining elapsed time between engine shut down and startup, and calculating the engine oil temperature at startup based on the engine coolant temperature value, the shutdown engine oil temperature value retrieved from memory, and the elapsed time.

The present invention provides a number of advantages. For example, by more accurately determining engine oil temperature at startup, the present invention is capable of improving driveability, particularly for VCT engines. The present invention eliminates the need for an engine oil temperature sensor for applications which require an accurate temperature.

The above advantages and other advantages, objects, and features of the present invention, will be readily apparent from the following detailed description of the best mode for carrying out the invention when taken in connection with the accompanying drawings.

BEST MODE FOR CARRYING OUT THE INVENTION

As will be appreciated by those of ordinary skill in the art, the present invention is independent of the particular engine technology and may be used in a variety of types of internal combustion engines which use engine oil temperature for informational, diagnostic, and/or control purposes. For example, the present invention may be used in conventional engines in addition to direct injection stratified charge (DISC) or direct injection spark ignition (DISI) engines which may use VCT or variable valve timing mechanisms, for example.

Figure 1:
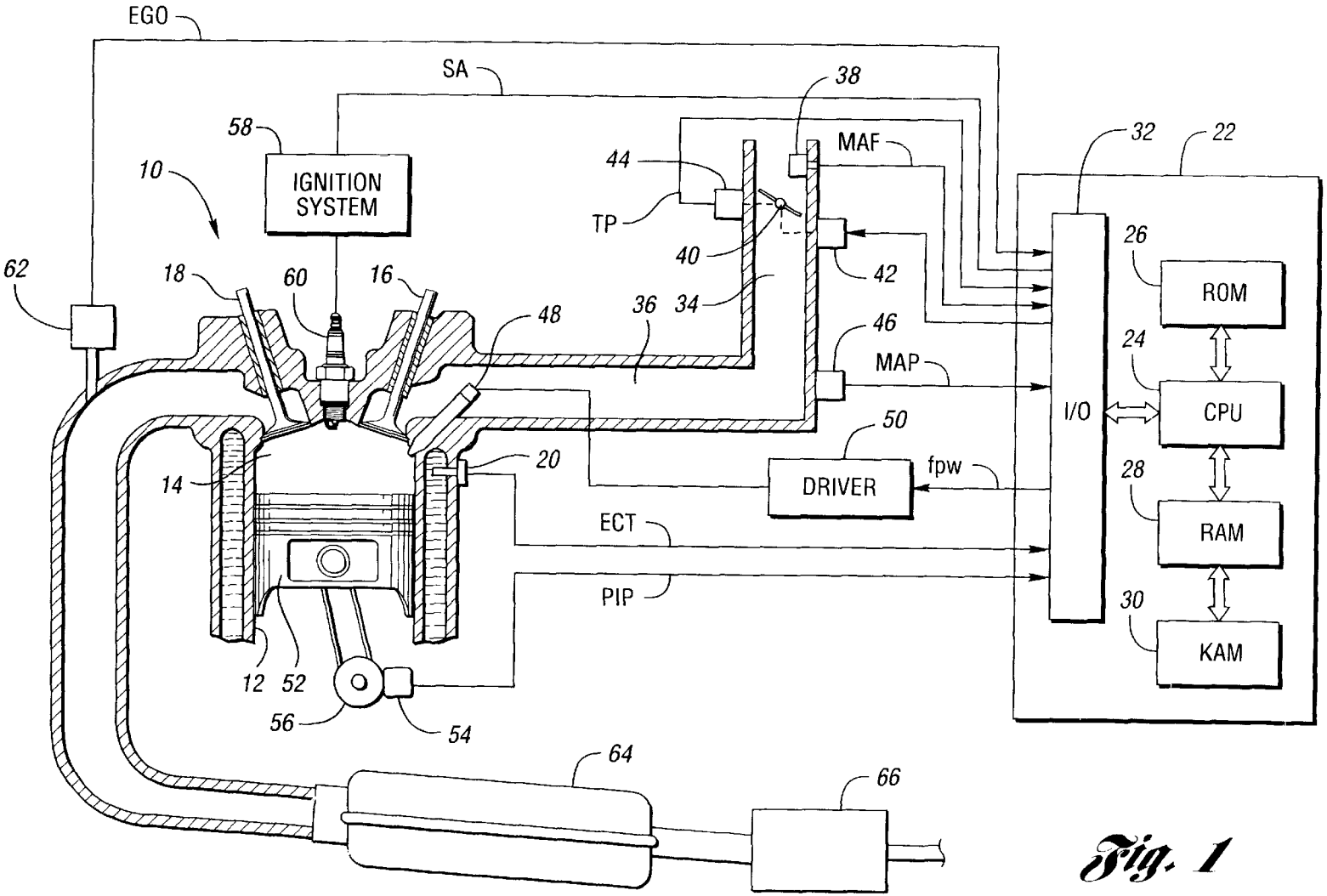
FIG. 1 is a block diagram illustrating operation of one embodiment of a system or method for determining engine oil temperature at startup according to the present invention.

A block diagram illustrating an engine control system for a representative internal combustion engine according to the present invention is shown in FIG. 1. System 10 preferably includes an internal combustion engine having a plurality of cylinders, represented by cylinder 12, having corresponding combustion chambers 14. As one of ordinary skill in the art will appreciate, system 10 includes various sensors and actuators to effect control of the engine. One or more sensors or actuators may be provided for each cylinder 12, or a single sensor or actuator may be provided for the engine. For example, each cylinder 12 may include four actuators which operate the intake valves 16 and exhaust valves 18, while only including a single engine coolant temperature sensor 20.

System 10 preferably includes a controller 22 having a microprocessor 24 in communication with various computer-readable storage media. The computer readable storage media preferably include a read-only memory (ROM) 26, a random-access memory (RAM) 28, and a keep-alive memory (KAM) 30. As known by those of ordinary skill in the art, KAM 30 is used to store various operating variables while controller 22 is powered down but is connected to the vehicle battery (not shown). The computer-readable storage media may be implemented using any of a number of known memory devices such as PROMs, EPROMs, EEPROMs, flash memory, or any other electric, magnetic, optical, or combination memory device capable of storing data, some of which represents executable instructions, used by microprocessor 24 in controlling the engine. Microprocessor 24 communicates with the various sensors and actuators via an input/output (I/O) interface 32. Of course, the present invention could utilize more than one physical controller, such as controller 22, to provide engine/vehicle control depending upon the particular application.

In operation, air passes through intake 34 where it may be distributed to the plurality of cylinders via an intake manifold, indicated generally by reference numeral 36. System 10 preferably includes a mass airflow sensor 38 which provides a corresponding signal (MAF) to controller 22 indicative of the mass airflow. If no mass airflow sensor is present, a mass airflow value may be inferred from various engine operating parameters. A throttle valve 40 may be used to modulate the airflow through intake 34 during certain operating modes. Throttle valve 40 is preferably electronically controlled by an appropriate actuator 42 based on a corresponding throttle position signal generated by controller 22. A throttle position sensor 44 provides a feedback signal (TP) indicative of the actual position of throttle valve 40 to controller 22 to implement closed loop control of throttle valve 40.

As illustrated in FIG. 1, a manifold absolute pressure sensor 46 may be used to provide a signal (MAP) indicative of the manifold pressure to controller 22. Air passing through intake manifold 36 enters combustion chamber 14 through appropriate control of one or more intake valves 16. Intake valves 16 and exhaust valves 18 may be controlled directly or indirectly by controller 22 for variable valve timing or variable cam timing applications, respectively. Alternatively, intake valves 16 and exhaust valves 18 may be controlled using a conventional camshaft arrangement. A fuel injector 48 injects an appropriate quantity of fuel in one or more injection events for the current operating mode based on a signal (FPW) generated by controller 22 processed by driver 50. Control of the fuel injection events is generally based on the position of piston 52 within cylinder 12. Position information is acquired by an appropriate sensor 54 which provides a position signal (PIP) indicative of rotational position of crankshaft 56. At the appropriate time during the combustion cycle, controller 22 generates a spark signal (SA) which is processed by ignition system 58 to control spark plug 60 and initiate combustion within chamber 14.

Controller 22 (or a conventional camshaft arrangement) controls one or more exhaust valves 18 to exhaust the combusted air/fuel mixture through an exhaust manifold. An exhaust gas oxygen sensor 62 provides a signal (EGO) indicative of the oxygen content of the exhaust gases to controller 22. This signal may be used to adjust the air/fuel ratio, or control the operating mode of one or more cylinders. The exhaust gas is passed through the exhaust manifold and through a catalytic converter 64 and NO, trap 66 before being exhausted to atmosphere.

According to the present invention, controller 22 determines or calculates an inferred engine oil temperature at engine startup based on various signals provided by sensors such as engine coolant temperature (ECT) as determined by sensor 20. The present invention provides a more accurate initialization value for engine oil temperature which allows more precise engine control during cranking and during the first few minutes of engine operation. When the engine is powered down, controller 22 stores a value representative of the latest determined engine oil temperature in KAM 30. The stored value is subsequently retrieved upon power-up and used to infer the current engine oil temperature based on various parameters which may include engine coolant temperature, soak time, ambient temperature, and whether an engine block heater has been used. In addition, controller 22 accounts for the possibility that the driver has the key on with the engine not running by allowing the calculation for engine oil temperature to adjust to changes in engine coolant temperature so its value is valid when the engine is finally started.

Figure 2:
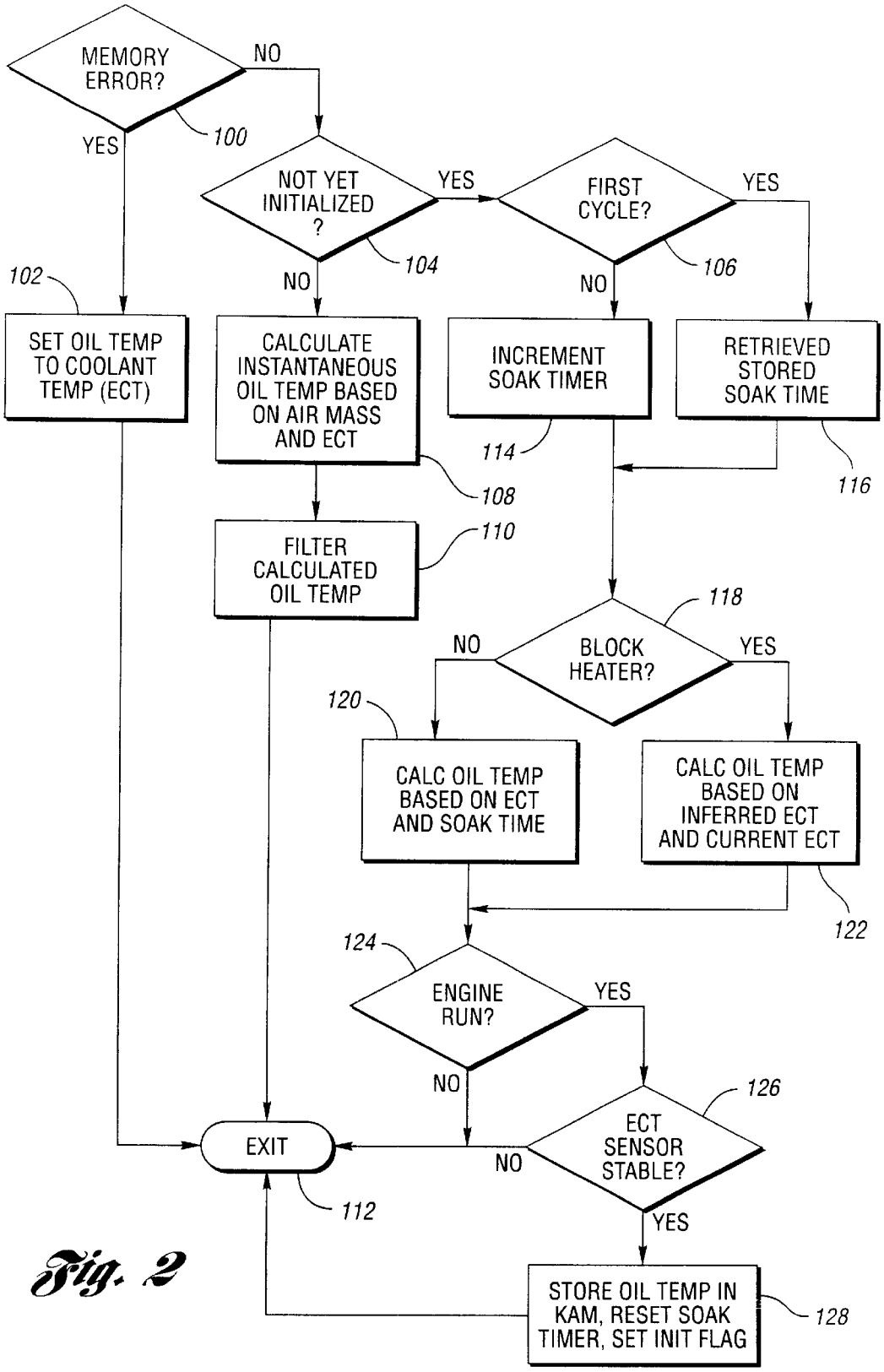
FIG. 2 is a flowchart illustrating operation of one embodiment of a system or method for determining engine oil temperature at engine startup according to the present invention.
Figure 3:
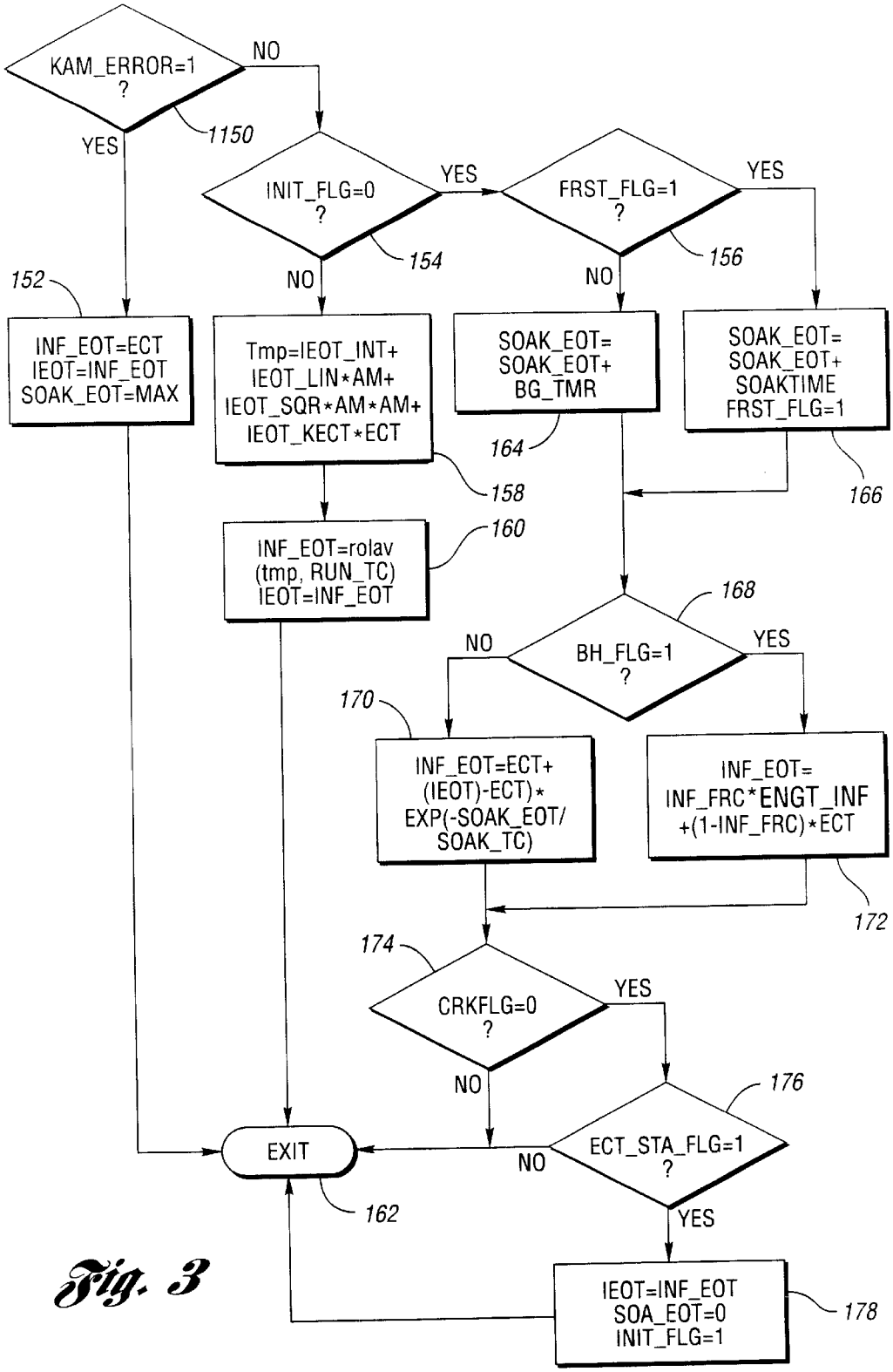
FIG. 3 is a more detailed flowchart illustrating operation of a system or method for determining engine oil temperature at engine startup according to the present invention.

Diagrams illustrating operation of systems and methods for determining engine oil temperature at startup are provided in FIGS. 2 and 3. The diagrams generally represent control logic of one embodiment of a system or method according to the present invention. As will be appreciated by one of ordinary skill in the art, the diagrams may represent any one or more of a number of known processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages of the invention, but is provided for ease of illustration and description. Although not explicitly illustrated, one of ordinary skill in the art will recognize that one or more of the illustrated steps or functions may be repeatedly performed depending upon the particular processing strategy being used.

Preferably, the control logic is implemented primarily in software executed by a microprocessor-based engine controller. Of course, the control logic may be implemented in software, hardware, or a combination of software and hardware depending upon the particular application. When implemented in software, the control logic is preferably provided in a computer-readable storage medium having stored data representing instructions executed by a computer to control the engine. The computer-readable storage medium or media may be any of a number of known physical devices which utilize electric, magnetic, and/or optical devices to temporarily or persistently store executable instructions and associated calibration information, operating variables, and the like.

Referring now to FIG. 2, block 100 determines whether an error has been encountered when attempting to retrieve the previously stored value for engine oil temperature from keep-alive memory (KAM). If an error is encountered, the engine oil temperature is initialized to the current engine coolant temperature (ECT) as indicated by the associated engine coolant temperature sensor. A memory error may be indicated by block 100 if the stored data has been corrupted or is outside of a predetermined acceptable range of temperatures.

If the previous value can be retrieved from memory, block 104 determines whether the inferred engine oil temperature has been initialized which corresponds to determining whether the engine is in start mode or run mode. If the engine oil temperature has not been initialized as indicated by block 104, the engine is in start mode and block 106 determines whether this is the first cycle or first time through the start mode loop. This test is used to detect a condition where the engine controller is powered up for a period of time without attempting to start the engine, such as may occur when operating various vehicle accessories such as a radio, for example. As explained in greater detail below, while the engine remains in crank mode, the inferred engine oil temperature value stored in keep-alive memory does not change. However, the corresponding engine oil temperature value stored in RAM is constantly reset to the value stored in KAM in this mode so that the value is valid when the engine is actually started.

If the engine oil temperature value in RAM has been initialized as indicated by block 104, the engine is in run mode and the oil temperature is calculated based on intake air mass, as determined by the mass airflow sensor or inferred from other parameters, and engine coolant temperature as determined by the associated coolant temperature sensor as represented by block 108. The instantaneous value determined by block 108 is then filtered to provide an average value as represented by block 110. Preferably, a rolling average filter is used to provide the engine oil temperature as represented by block 110. The determination is completed and exits as represented by block 112. As described above, the process is preferably repeated at predetermined intervals corresponding to a background loop timer and may be triggered by various engine operating events, such as starting or stopping the engine.

In start mode, block 106 determines whether this is the first time through the loop or cycle. On the first pass, a local soak timer is created by retrieving a stored soak time from memory as represented by block 116. The soak time represents the elapsed time between the previous engine shutdown and current engine startup. On subsequent passes, block 114 increments the local copy of the engine-off time to account for the driver having the key on without cranking the engine.

Block 118 determines whether an engine block heater has been used to maintain the temperature of the engine block above ambient temperature. With no block heater, or where a block heater is present but has not been used, engine oil temperature decays from its value at power-down toward the engine coolant temperature, which in turn decays toward ambient temperature during a long enough soak time. During some short soaks, oil temperature may actually increase toward a higher engine coolant temperature. As such, when a block heater is not present or not used as determined by block 118, block 120 calculates the engine oil temperature based on engine coolant temperature and soak time. Preferably, the engine oil temperature is calculated based on an exponential decay by adding the current engine coolant temperature to the difference between the previously stored engine oil temperature and the engine coolant temperature times an exponential function of the soak time with an appropriate time constant which may be determined empirically, for example.

When a block heater has been used as determined by block 118, engine oil temperature will be somewhat above ambient temperature, but oil in the sump will not be as warm as the engine coolant in the engine block which is heated by the block heater. As such, the measured engine coolant temperature is adjusted to account for the engine soak time to what the temperature would have been without a block heater. The calculation for engine oil temperature, represented by block 122, sets the inferred engine oil temperature to an intermediate value between ambient temperature and current engine coolant temperature. The oil temperature is then calculated based on the adjusted engine coolant temperature and current engine coolant temperature as described in greater detail below.

Block 124 determines whether the engine is running. As known, the engine oil temperature will generally track the engine coolant temperature while the engine is running. The relationship between oil temperature and coolant temperature is a function of the amount of loading on the engine. For the embodiment illustrated in FIG. 2, the air mass flow is used as a measure of engine loading as represented by block 108. If the engine has reached running speed, i.e. the engine is not cranking, block 126 determines whether sufficient time has elapsed for the engine coolant temperature sensor to stabilize. If sufficient time has elapsed, block 128 stores the calculated engine oil temperature in KAM, resets the soak timer, and sets a flag indicating that the oil temperature has been initialized (as subsequently tested by block 104).

FIG. 3 provides a more detailed diagram illustrating operation of a system or method for determining engine oil temperature according to one preferred embodiment of the present invention. Block 150 tests a flag (KAM_ERROR) to determine whether the keep-alive memory is reliable. A value of one indicates that the keep-alive memory has been corrupted, in which case, block 152 sets the inferred engine oil temperature to the value representing the engine coolant temperature (ECT) and sets a local copy of the engine powered-down timer (SOAK_EOT)to its maximum allowable value.

If the flag tested at block 150 indicates the data stored in memory is reliable, block 154 tests a flag (INIT_FLG) indicating that initialization of the local copy of the inferred engine oil temperature (IEOT) has completed. If not completed, block 156 tests a flag (FRST_FLG) indicating that the initial pass through this process has been completed. A value of one indicates that the initial pass has been completed.

If the local copy of the inferred engine oil temperature has not been initialized as determined by block 154, and block 156 determines that this is the initial pass through the process, block 166 sets the local copy of the engine powered-down timer (SOAK_EOT) to the value stored in memory (SOAKTIME) which represents the number of minutes or elapsed time that the engine has been powered down. This information is readily available on modern engine electronic control modules. On subsequent passes or cycles through the process, block 164 increments the local copy of the timer (SOAK_EOT) using the background loop timer (BG_TMR).

Block 168 examines a flag (BH_FLG) to determine whether an engine block heater was used prior to this power-up. Where a block heater has been used, block 172 calculates the inferred engine oil temperature based on a calibratible fraction (INF_FRC) of the inferred engine coolant temperature value (ENGT_INF) which represents the inferred value that engine coolant temperature would have been at startup had no block heater been present. This inferred temperature is based on measured engine coolant temperature at power-down and decays toward ambient temperature as soak time increases.

If a block heater is not present or has not been used, block 170 determines the inferred engine oil temperature based on the current engine coolant temperature (ECT) and a difference (IEOT_ECT) multiplied by an exponential function of the soak time (SOAK_EOT) with an appropriate time constant (SOAK_TC) which represents the rate at which the oil temperature decays during a soak. The time constant may be determined analytically or empirically based on the particular application.

Block 174 examines a flag (CRKFLG) to determine whether the engine is in crank mode. A value of one indicates that crank mode is active. If the engine is not in crank mode, block 176 examines another flag (ECT_STA_FLG) which indicates that the measured value of engine coolant temperature has had enough time after power-up to be reliable for use in controlling the engine. A value of one indicates the engine coolant temperature data provided by the coolant temperature sensor should be reliable. In this case, block 178 stores the local value for the inferred engine oil temperature in keep-alive memory for subsequent use, resets the local value for the soak timer, and sets the initialization flag (INIT_FLG) to a value of one.

If the local copy of the inferred engine oil temperature has not yet been initialized as determined by block 154, block 158 uses a temporary register (tmp) to calculate the instantaneous value of the inferred engine oil temperature prior to filtering. As represented by block 158, the instantaneous value is calculated while the engine is running based on a calibratible offset of the inferred engine oil temperature relative to the engine coolant temperature (IEOT_INT), a calibratible adder (IEOT_LIN) which is a linear function of air mass (AM), a calibratible adder (IEOT_SQR) which is a function of air mass squared, and a calibratible multiplier of engine coolant temperature (IEOT_KECT). The instantaneous value is then filtered as represented by block 160. Preferably, the instantaneous value is filtered using a rolling average (rolav) function with an appropriate time constant (RUN_TC). Empirical data has shown that the oil temperature may warm up significantly more slowly than the engine coolant temperature. In addition, the engine coolant temperature value is subject to relatively quick positive and negative changes as compared to the engine oil temperature. As such, a relatively slow time constant (RUN_TC) is preferably used to filter the instantaneous value.

As described above, the present invention calculates a more accurate initialization value of inferred oil temperature at engine startup which allows more precise engine control during cranking and during the first few minutes of engine operation. The initial value for the inferred engine oil temperature is accurate at power-up whether or not a block heater has been used. In addition, the present invention accounts for engine oil temperature variation which may result from having the electronic control module powered up for a long time prior to cranking the engine, such as when using vehicle accessories.

While the best mode for carrying out the invention has been described in detail, those familiar with the art to which this invention relates will recognize various alternative designs and embodiments for practicing the invention as defined by the following claims.

What is claimed is:

1. A method for determining engine oil temperature at engine startup for an internal combustion engine, the method comprising:

retrieving a shutdown engine oil temperature value previously stored in memory prior to the engine being shutdown;

determining a value indicative of engine coolant temperature;

determining elapsed time between engine shut down and startup; and calculating the engine oil temperature at startup based on the engine coolant temperature value, the shutdown engine oil temperature value retrieved from memory, and the elapsed time.

2. The method of claim 1 wherein the step of calculating comprises adding the engine coolant temperature value to the difference between the engine coolant temperature value and the last engine oil temperature value multiplied by an exponential function of the elapsed time.

3. The method of claim 1 further comprising:

setting the engine oil temperature value to the engine coolant temperature value if an error occurs during the step of retrieving a shutdown engine oil temperature value previously stored in memory.

4. The method of claim 1 wherein the internal combustion engine includes a block heater used to maintain the block at a temperature above ambient temperature, the method further comprising:

determining whether the block heater was used to warm the engine;

wherein the step of calculating the engine oil temperature includes adjusting the engine coolant temperature value based on an estimate of what engine coolant temperature would have been had no block heater been present if the bock heater was used to warm the engine.

5. The method of claim 4 wherein the step of calculating the engine oil temperature includes adjusting the engine coolant temperature value based on the ambient temperature and the elapsed time.

6. The method of claim 1 further comprising:

determining whether the engine is running; and calculating the engine oil temperature based on intake air mass and engine coolant temperature if the engine is determined to be running.

7. The method of claim 6 further comprising:

continuing to increment the elapsed time until the engine is determined to be running.

8. The method of claim 6 further comprising:

filtering the calculated engine oil temperature.

9. A system for determining engine oil temperature at engine startup for an internal combustion engine, the system comprising:

an engine coolant temperature sensor for providing a signal indicative of engine coolant temperature;

a mass airflow sensor for providing a signal indicative of intake mass airflow;

a controller in communication with the engine coolant temperature, the mass airflow sensor, and a memory, the controller retrieving a shutdown engine oil temperature value previously stored in the memory prior to the engine being shutdown, determining a value indicative of engine coolant temperature based on at least the signal received from the coolant temperature sensor, determining elapsed time between engine shut down and startup, and calculating the engine oil temperature at startup based on the engine coolant temperature value, the shutdown engine oil temperature value retrieved from memory, and the elapsed time.

10. The system of claim 9 wherein the controller adds the engine coolant temperature value to the difference between the engine coolant temperature value and the last engine oil temperature value multiplied by an exponential function of the elapsed time to determine the engine oil temperature at startup.

11. The system of claim 9 wherein the controller sets the engine oil temperature value to the engine coolant temperature value if an error occurs while retrieving the shutdown engine oil temperature value previously stored in memory.

12. The system of claim 9 further comprising an engine block heater in communication with the controller, wherein the controller determines whether the block heater was used to warm the engine and calculates the engine oil temperature by adjusting the engine coolant temperature value based on an estimate of what engine coolant temperature would have been had no block heater been present if the bock heater was used to warm the engine.

13. The system of claim 12 wherein the controller calculates engine oil temperature by adjusting the engine coolant temperature value based on ambient temperature and the elapsed time.

14. The system of claim 9 wherein the controller determines whether the engine is running and calculates the engine oil temperature based on the signal from the mass airflow sensor and the signal from the engine coolant temperature sensor if the engine is determined to be running.

15. The system of claim 14 wherein the controller continues to increment the elapsed time until the engine is determined to be running.

16. A computer readable storage medium having stored data representing instructions executable by a computer to determine engine oil temperature at engine startup for an internal combustion engine, the computer readable storage medium comprising:

instructions for retrieving a shutdown engine oil temperature value previously stored in memory prior to the engine being shutdown;

instructions for determining a value indicative of engine coolant temperature;

instructions for determining elapsed time between engine shut down and startup; and instructions for calculating the engine oil temperature at startup based on the engine coolant temperature value, the shutdown engine oil temperature value retrieved from memory, and the elapsed time.

17. The computer readable storage medium of claim 16 wherein the instructions for calculating comprise instructions for adding the engine coolant temperature value to the difference between the engine coolant temperature value and the last engine oil temperature value multiplied by an exponential function of the elapsed time.

18. The computer readable storage medium of claim 16 further comprising:

instructions for setting the engine oil temperature value to the engine coolant temperature value if an error occurs while retrieving the shutdown engine oil temperature value previously stored in memory.

19. The computer readable storage medium of claim 16 wherein the internal combustion engine includes a block heater used to maintain the block at a temperature above ambient temperature, the computer readable storage medium further comprising:

instructions for determining whether the block heater was used to warm the engine;

wherein the instructions for calculating the engine oil temperature include instructions for adjusting the engine coolant temperature value based on an estimate of what engine coolant temperature would have been had no block heater been present if the bock heater was used to warm the engine.

20. The computer readable storage medium of claim 19 wherein the instructions for calculating the engine oil temperature include instructions for adjusting the engine coolant temperature value based on the ambient temperature and the elapsed time.

21. The computer readable storage medium of claim 16 further comprising:

instructions for determining whether the engine is running; and instructions for calculating the engine oil temperature based on intake air mass and engine coolant temperature if the engine is determined to be running.

22. The computer readable storage medium of claim 21 further comprising:

instructions for continuing to increment the elapsed time until the engine is determined to be running.

* * * * *